United States Patent [19]

Srinivasan et al.

[11] Patent Number: 4,931,151

[45] Date of Patent: Jun. 5, 1990

[54] METHOD FOR TWO STEP ELECTROLYTIC COLORING OF ANODIZED ALUMINUM

[75] Inventors: Kollengode V. Srinivasan, Marietta, Ga.; Leo P. Herrington, Walker, Mich.; Mores A. Basaly, Marietta, Ga.; Harold W. Poulsen, Fort Wayne, Ind.

[73] Assignee: Novamax Technologies Holdings Inc., Ontario, Canada

[21] Appl. No.: 336,114

[22] Filed: Apr. 11, 1989

[51] Int. Cl.[5] ..... C25D 11/22

[52] U.S. Cl. ..... 204/376; 204/42; 204/DIG. 9

[58] Field of Search ..... 204/37.6, 38.3, 42, 204/DIG. 9

[56] References Cited

U.S. PATENT DOCUMENTS

| | | | |
|---|---|---|---|
| 3,524,799 | 8/1970 | Dale | 204/58 |
| 3,616,309 | 10/1971 | Asada et al. | 204/58 |
| 3,669,856 | 6/1972 | Gedde | 204/58 |
| 3,769,180 | 10/1973 | Gedde | 204/35 N |
| 3,849,263 | 11/1974 | Gedde | 204/35 N |
| 3,929,593 | 12/1975 | Sugiyama et al. | 204/35 N |
| 3,977,948 | 8/1976 | Martinez | 204/35 N |
| 4,014,758 | 3/1977 | Kawai et al. | 204/28 |
| 4,147,598 | 4/1979 | Shigeta et al. | 204/35 N |
| 4,179,342 | 12/1979 | Walsh | 204/35 N |
| 4,180,443 | 12/1979 | Darrow | 204/35 N |
| 4,316,780 | 2/1982 | Yoshida et al. | 204/35 N |
| 4,414,077 | 11/1983 | Yoshida et al. | 204/35 N |
| 4,421,610 | 12/1983 | Rodriguez | 204/35 N |
| 4,430,168 | 2/1984 | Gazapo Santa-Olalla | 204/35 N |
| 4,571,287 | 2/1986 | Okubo et al. | 204/37.6 |
| 4,798,656 | 1/1989 | Paulet | 204/37.6 |
| 4,808,280 | 2/1989 | Hinoda | 204/37.6 |

OTHER PUBLICATIONS

"Two-Step Electrolytic Tin Color Anodizing", *Aluminum Finishing West*, May 12-14, 1987, pp. 13/1-13/18.

"Two-Step Electrolytic Coloring Process", *Aluminum Finishing* '88, Apr. 26-28, 1988, pp. 15/1-15/10.

*Primary Examiner*—John F. Niebling

*Assistant Examiner*—William T. Leader

*Attorney, Agent, or Firm*—Marshall, O'Toole, Gerstein, Murray & Bicknell

[57] ABSTRACT

A two-step process and apparatus for the electrolytic coloring of anodized aluminum using an electrode and the anodized aluminum immersed in an electrolyte. First the aluminum is anodized to form an oxidized film on its surface and then a coloring step is performed. In the coloring step a modified sinusoidal voltage waveform is applied to the anodized aluminum and the electrode to color the oxidized film. Suitably gated thyristors in the secondary of a power supply may be used to provide the desired voltage waveform. The voltage waveform is generated with a leading edge rise time in the negative portion substantially longer than in the positive portion. The average negative voltage is greater than the average positive voltage to provide good throwing power, coloring speed, color uniformity and electrode dissolution, with tha capability to subtract color. Excellent throwing power with fair coloring speed is obtained if the average negative voltage substantially equals the average positive voltage.

8 Claims, 3 Drawing Sheets

METHOD FOR TWO STEP ELECTROLYTIC COLORING OF ANODIZED ALUMINUM

This invention relates to a two-step process for the electrolytic coloring of anodized aluminum.

Background Of The Invention

It has been known that colored anodic oxide films can be produced on aluminum or aluminum alloys by a two-step electrolytic coloring process. In such a process the aluminum is first anodized in a suitable sulphuric acid electrolyte to produce anodically oxidized films, then colored by subjecting it to an electrolytic process in a bath of electrolyte having a metal salt or salts dissolved in such a manner that the metal being deposited may also serve as the counter electrodes. The commonly used metals are tin, nickel and cobalt.

Many types of voltage waveforms supplied by alternating current power supplies, and connected between the electrode and the aluminum workpiece, have been used to color the oxide film on the aluminum workpiece in the coloring step. The most common of such prior art voltage waveforms is a standard sinusoidal waveform containing symmetrical positive and negative half cycle portions as shown for instance in FIG. 1. While such a voltage sinusoidal waveform is generally preferred since it can be readily provided by conventional sine wave AC power supplies, it does not provide all of the desired results in commercial operations.

As an example, in the coloring of anodized aluminum it is desired to have good throwing power (i.e. the ability to obtain good color uniformity and particularly in narrow, deeply recessed, and tight surface areas of an aluminum workpiece and when such workpieces are racked close together during coloring), good coloring speed, good dissolution of the electrode, and the ability to subtract color, if desired, from the aluminum workpiece, as when the color produced is darker than the desired color standard. The symmetrical AC sine voltage waveform of FIG. 1 produces good color uniformity and throwing power, but has the notable disadvantage of slow coloring speed, minimal electrode dissolution, and does not provide the ability to subtract color.

In an improvement, FIG. 2(*a*) illustrates a prior art AC power supply having thyristors and wherein the respective thyristor firing times are controlled using analog electronic circuitry or by a computer to provide the modified sinusoidal waveform shown in FIG. 2(*b*). In accordance with one well known technique for instance the thyristor firing times are obtained by using a zero crossing detector signal to initiate a timer that supplies a trigger pulse to the thyristor at the appropriate times of the voltage waveform cycle. The prior art modified sinusoidal waveform of FIG. 2(*b*) is obtained by firing the thyristor associated with the positive half cycle at a different time during the positive half cycle than the thyristor associated with the negative half cycle. Accordingly, the modified sinusoidal waveform provides a negative half cycle portion with a higher average voltage than the positive half cycle portion and wherein the leading edges of the waveform in each positive and negative half cycles have very fast rise times (i.e., very short time values) of substantially proportional values. When compared to the standard sinusoidal waveform of FIG. 1, the modified sinusoidal waveform provides fairly good overall color uniformity, and with the distinct advantage of fast coloring speed, excellent electrode dissolution, and the ability to subtract color. However, poor throwing power is obtained thereby severely limiting the ability to attain uniform coloring in deeply recessed surface areas of the workpiece.

Accordingly, it is desired to provide method and apparatus for a coloring step in a two-step process for coloring anodized aluminum wherein there is achieved excellent throwing power, good overall color uniformity, good coloring speed and electrode dissolution, and with the added ability to subtract color when desired.

SUMMARY OF THE INVENTION

A significant improvement in a two-step process for the electrolytic coloring of anodized aluminum is obtained by utilizing an alternating voltage waveform in which the negative half cycle portion has a leading edge rise time (tn) which is substantially longer (slower) than the leading edge rise time of the positive half cycle portion (tp), and where the average voltage of the negative half cycle portion is equal to or greater than the average voltage of the positive half cycle portion. It has been found that when such a voltage waveform is applied to the anodized aluminum and the counter electrode in a coloring step to color the oxidized film, excellent throwing power, good coloring speed, good all around color uniformity (even when the workpieces are racked very close together), and good electrode dissolution are obtained along with the capability to subtract color when desired.

In particular, it has been found that the best throwing power is obtained when such a voltage waveform has the average voltage of the negative and positive half cycle portions equal, although the coloring speed is then slower. Excellent throwing power and good coloring speed is obtained when such a voltage waveform has the average voltage of the negative half cycle greater than the positive half cycle.

With respect to the leading edge rise times, excellent throwing power is attained when tn is much longer (slower) than tp, such as, where the positive half cycle leading edge is substantially a step of very fast rise time, tp, and the negative half cycle leading edge is a sinusoid of much slower rise time, tn. In terms of the measured slope of the respective leading edges of the positive and negative half cycle portions, it was found preferable to have the slope of the positive leading edge to be greater than 15–70 kilovolts/second; the slope of the negative leading edge to be less than 15–70 or more kilovolts/-second; and the positive slope to be greater than the negative slope.

BRIEF DESCRIPTION OF THE DRAWINGS

The features of this invention which are believed to be novel are set forth with particularity in the appended claims. The invention, together with its object and the advantages thereof, may be best understood by reference to the following description taken in conjunction with the accompanying drawings, in which like reference numerals identify like elements in the several figures and in which:

DETAILED DESCRIPTION

Figure 2A:
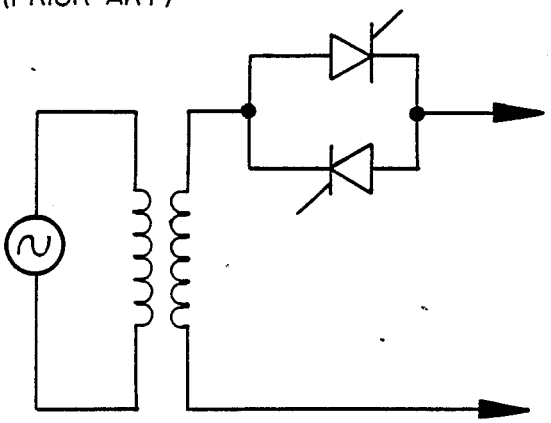
FIG. 2a (PRIOR ART)
FIG. 2(*a*) is a schematic diagram of a prior art power supply for supplying alternative coloring waveforms, and FIG. 2(*b*) is an illustrated prior art modified sinusoidal waveform produced by the power supply of FIG. 2(*a*)
Figure 2B:
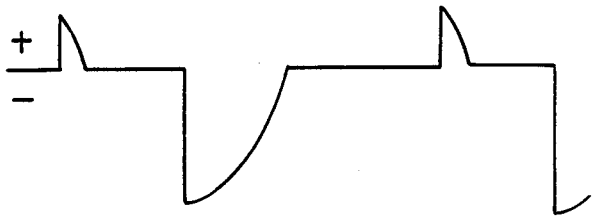
FIG. 2b (PRIOR ART)
Figure 3:
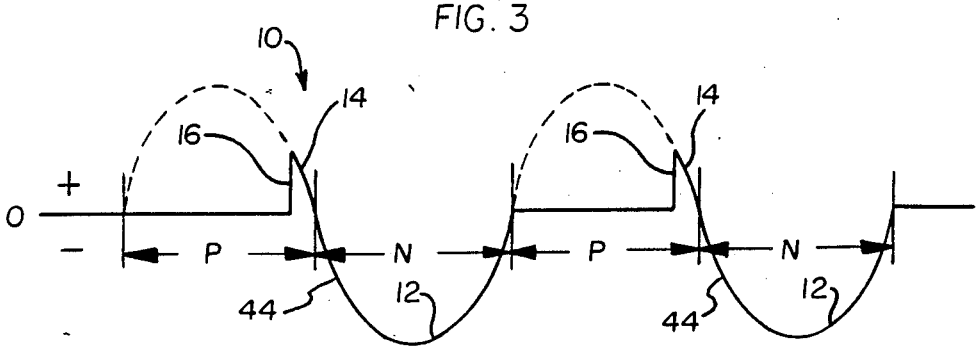
FIG. 3 illustrates a modified sinusoidal voltage waveform in accordance with the present invention.

Referring to FIG. 3, there is illustrated a modified sinusoidal voltage waveform 10 in accordance with the principles of the present invention, waveform 10 having a positive half wave portion P and a negative half wave portion N. In the negative half cycle portion of waveform 10, a full sinusoidal half wave 12 is provided. In the positive half cycle portion of waveform 10, only a portion 14 of the half wave is provided so that the average voltage of the negative half cycle is equal to or greater than the positive half cycle. The positive half cycle includes a leading edge 16 rapidly rising step-wise from the reference zero level for waveform 10. Leading edge 16 therefore has a very fast rise time, tp, of very short time values, similar to that shown in the prior art waveform of FIG. 2(*b*), when compared to the much slower rise time, tn, of the leading edge 44 of the negative sinusoidal half wave 12.

It has been found that by utilizing modified sinusoidal voltage waveform 10 in the coloring step of the two-step electrolytic coloring of anodized aluminum, good operational characteristics can be achieved which are significant improvements compared to the prior art.

Figure 4:
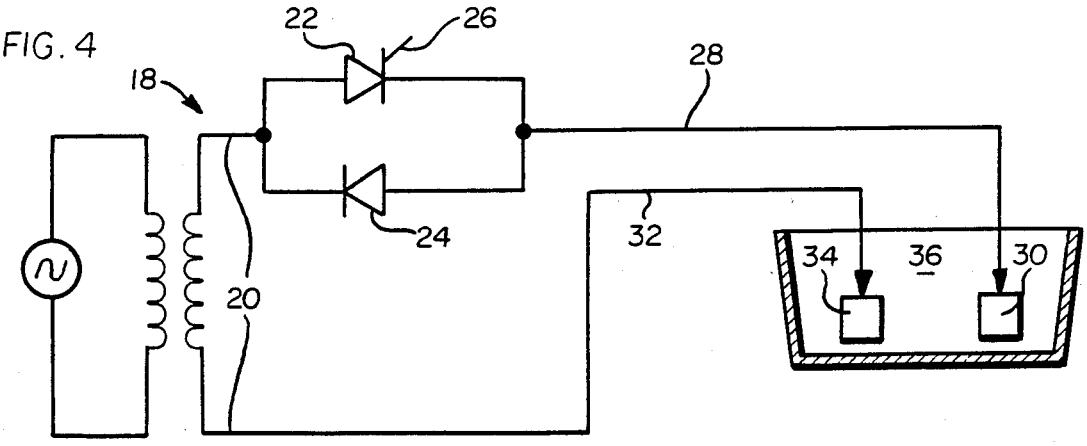
FIG. 4 is a schematic diagram illustrating a power supply apparatus for supplying the waveform of FIG. 3.

Referring now to FIG. 4, there is illustrated a power supply 18 wherein the developed sinusoidal voltage at transformer output leads 20 is modified by a thyristor 22 and a diode 24. Thyristor 22 sets the positive average voltage output of power supply 18 to be less than or equal to the negative. Suitable timing and control of thyristor gate lead 26 provides fast rise time leading edge 16 and positive portion 14 of sine wave 10. A suitable control signal for instance may be coupled to thyristor gate lead 26 near the end of the positive half cycle to gate the thyristor on and provide a step leading edge 16 and positive portion 14. Diode 24 passes the negative part of the wave form at terminals 20 so as to provide a smooth half sine wave such as negative half cycle portions 12 of waveform 10.

One output lead 28 is connected to the anodized aluminum workpiece 30 and the other output lead 32 is connected to a counter electrode 34 where both the aluminum workpiece and counter electrode are placed within a suitable electrolyte 36.

Figure 5:
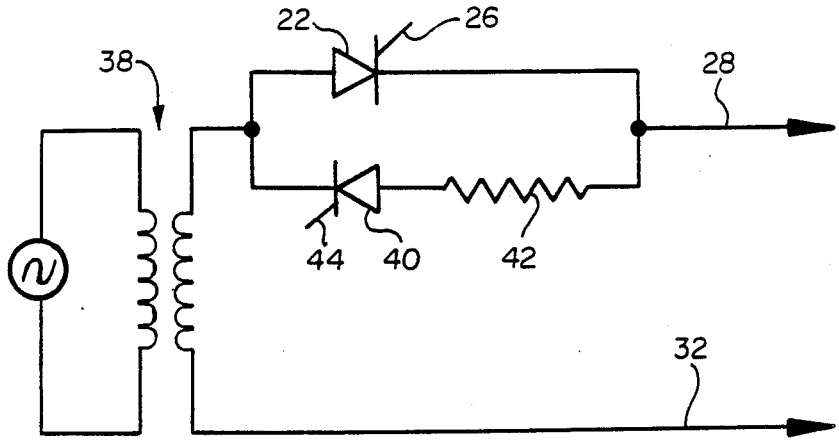
FIG. 5 is a schematic diagram illustrating alternative power supply apparatus for supplying the preferred modified sinusoidal voltage waveform of FIG. 3.

An alternative power supply 38 shown in FIG. 5 may be provided for developing modified sinusoidal voltage waveform 10 with control signals coupled to thyristor gate lead 44. In this instance, thyristor 22 still supplies the same positive portion of waveform 10 with the steep rising leading edge 16 and a small portion 14 of the positive waveform. However, in this instance, another thyristor 40 is coupled to a resistor 42 to produce negative half cycle portion 12 of waveform 10 with control signals coupled to thyristor gate lead 14.

It has been found that a significant improvement in throwing power is obtained in a two-step coloring process when waveform 10 is coupled to the oxidized aluminum workpiece 30 and counter electrode 34 during the coloring step. Accordingly, waveform 10 maintains all the existing advantages of the prior art modified sine wave illustrated in FIG. 1(*b*) while achieving significant improvement in throwing power to achieve all around color uniformity even in deeply recessed surface areas and even when several of such workpieces are racked close together during coloring of workpiece 30. This allows for a significant increase in the work size load, so that the parts can be racked closer together and complex shaped aluminum extrusions still can be uniformly colored. At the same time, previously achieved advantages of good coloring speed as well as good electrode dissolution and the ability to remove color which are achieved by the prior art waveform of FIG. 2(*b*) can also be retained with waveform 10 of the present invention.

Experiments conducted using waveform 10 have shown that the negative going slope of leading edge 44 of negative portion 12 appears to be the most sensitive in offering the greater improvement in throwing power for the least adjustment in slope or other features of the wave shape. As an example and without prejudice to limiting the scope of the present invention, it has been found that exceptional improvement in throwing power is attained when the positive leading edge 16 rise time, tp, is much faster than the negative leading edge 44 rise time, tn, and where the slope of the positive leading edge is greater than about 15–70 kilovolts/second and the slope of the negative leading edge is less than about 15–70 or more kilovolts/second.

Figure 1:
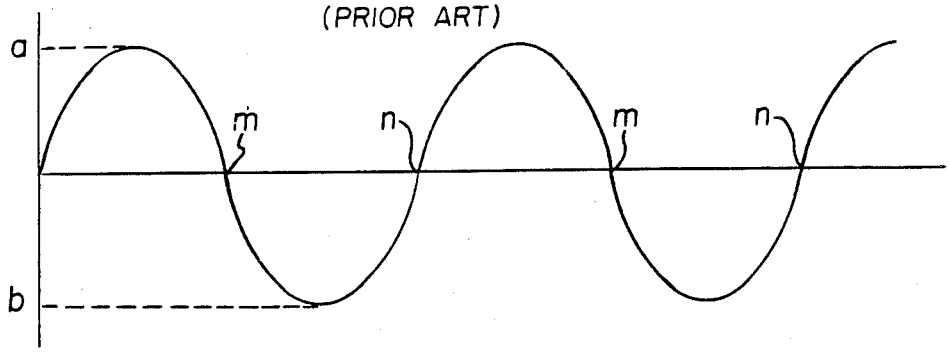
FIG. 1 (PRIOR ART)
FIG. 1 illustrates a sinusoidal waveform used in the prior art in electrolytic coloring of aluminum.

The following sets forth several experimental tests which were conducted to compare waveform 10 of the present invention against various prior art waveforms including that of FIG. 1 and FIG. 2(*b*) with respect to the aforementioned desired operational factors of throwing power, coloring speed, anode dissolution, and the ability to subtract color.

For purposes of comparison with respect to throwing power, a throwing power cell was designed and used for evaluating the various waveform performances under variable conditions. This throwing power cell consists of two aluminum panels 4"×6" and 4"×8" and racked side by side against each other on a rack with a one inch wide spline so that there was one inch spacing between the two panels. This one inch spline extended across the entire length of the two panels thus blocking those two sides completely. This limited the electrolyte flow between the panels and so was considered an excellent situation to study throwing power. The panels were anodized and colored in 2'×2'×2' anodize and coloring tanks. They were positioned such that the plane of the panels were parallel to the electrodes. The extent to which the color uniformly penetrates from the front to the back of the panels is taken to be indicative of the throwing power efficiency.

The panel cell was processed as follows:

1. Alkaline Soak Clean—5.0 minutes
2. Rinse
3. Alkaline Etch—5.0 minutes
4. Rinse
5. Deoxidize—2.0 minutes
6. Rinse
7. Anodizing—2'×2'×2' (60 gallon tank), 185 g/L free $H_2SO_4$, 8 g/L Al, 70° F., 24 Amps/sq.ft., 19 minutes to obtain 0.7 mils anodize film thickness
8. Rinse
9. Coloring—2'×2'×2' (60 gallon tank), 16 g/L $SnSO_4$. 20 g/L $H_2SO_4$ plus proprietary stabilizers and conditioners. Tin counter electrodes were used.

A throwing power index (TPI) was established to define the improvement in the throwing power, the scale being from 1 (poor throwing) up to 7 (excellent throwing). Overthrowing is caused by the use of a higher voltage than is required, whereas underthrowing is caused by the use of a lower voltage than is required.

EXAMPLE (1)

Several throwing power cells were processed using the anodizing process step mentioned previously, then colored using a sine wave AC power supply at various voltages to provide sinusoidal waveforms such as illustrated in prior art FIG. 1. The results are reported in Table 1.

TABLE 1

| Panel No. | AC Volts | T.P.I. |
|---|---|---|
| 1 | 14 | 2 |
| 2 | 15 | 2 |
| 3 | 16 | 2 |
| 4 | 17 | 3 |
| 5 | 18 | Overthrow |

Results
—The throwing power is acceptable
—Poor coloring speed
—Inability to subtract color
—Poor anode dissolution

EXAMPLE (2)

The same throwing power cells were processed using the aforementioned anodizing procedure, then colored using a prior art modified sinusoidal waveform and AC power supply such as illustrated in FIGS. 2(*b*) and 2(*a*) respectively. The results are tabulated in Table 2.

TABLE 2

| Panel No. | Positive Average Volts | Negative Average Volts | T.P.I. |
|---|---|---|---|
| 6 | 2.5 | 2.5 | Underthrow |
| 7 | 2.5 | 3.0 | 1 |
| 8 | 2.5 | 3.5 | 1 |
| 9 | 2.5 | 4.0 | Overthrow |
| 10 | 2.5 | 4.5 | Overthrow |

Results
—Very poor throwing power
—Good coloring speed
—Good anode dissolution
—Ability to subtract color

EXAMPLE (3)

The same process was repeated as in Example (1), (2). This time the cells were colored using the modified sinusoidal voltage waveform 10 of the present invention as shown in FIG. 3 with the leading edge rise time of the negative portion being longer than the leading edge rise time of the positive portion, and with the average negative voltage being greater than the average positive voltage. The results are reported in Table 3.

TABLE 3

| Panel No. | Positive Average Volts | Negative Average Volts | T.P.I. |
|---|---|---|---|
| 16 | 5 | 8 | 4–5 |
| 17 | 7 | 8 | 4 |
| 18 | 4 | 8 | 5 |
| 19 | 4 | 8 | 5 |

Results
—Good throwing power
—Good coloring speed
—Good anode dissolution
—Ability to subtract color The use of waveform 10 with the throwing power cell provides a significant improvement over currently available waveforms.

EXAMPLE (4)

The same process was repeated as in Examples (1), (2), and (3) above. We used the modified sinusoidal voltage waveform 10 of this invention as shown in FIG. 3, however, this time the average positive voltage was made equal to the average negative voltage while coloring the aluminum panels of the throwing power cell. These results are reported in Table 4 below.

TABLE 4

| Panel No. | Positive Average Volts | Negative Average Volts | T.P.I. |
|---|---|---|---|
| 20 | 8 | 8 | 7 |

Results
—Exceptional throwing power and best uniform coloring
—Slow coloring speed
—No ability to subtract color In order to further verify the validity of the coloring results obtained with the throwing power cells and the various waveforms cited in the above examples, it was decided to test coloring using actual aluminum extrusions. Example 5 and 6 below, discuss the coloring results with the extrusions.

Examples (5) and (6)

Two pieces of complex shaped aluminum extrusions of 6063-T6 alloy, 16" long were racked on a spline in such a manner that the complex shapes were facing inward towards the spline and away from the electrodes as introduced into the anodizing and coloring tanks. Further, the spacing between the two extrusions was only ¼", which would make it normally very difficult for the color to penetrate.

Figure 6:
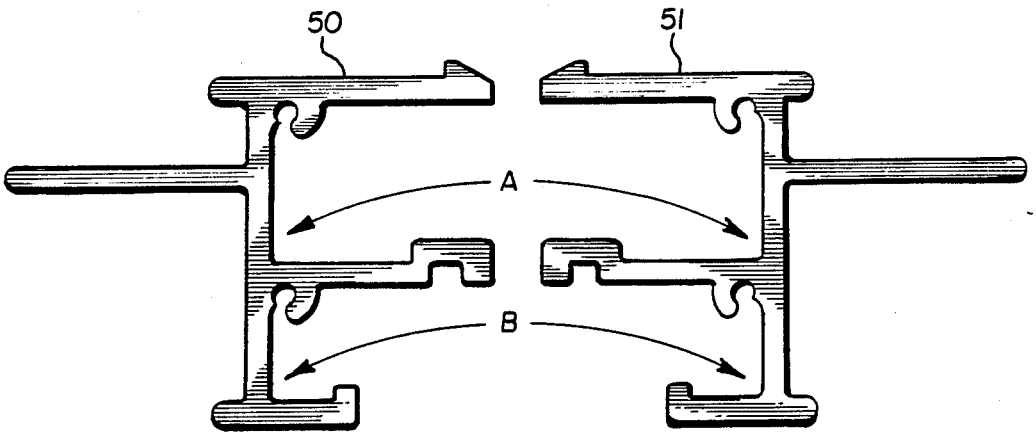
FIG. 6 is a schematic diagram illustrating the cross section of an aluminum test piece with deeply recessed surface areas and which is useful in describing the invention.

In the first test, Example 5, the aluminum extrusions were processed in the standard manner and then colored using the prior art waveform of FIG. 2(*b*). The cross sectional area and spacing of the extrusions 50, 51 is shown in the drawing illustration of FIG. 6. Area A is, very difficult to color, while area B is, by comparison somewhat less difficult to color. The same experiment with extrusion coloring was then repeated in the next test, Example 6, but this time using the modified sinusoidal voltage waveform 10 of this invention as shown in FIG. 3, with the average negative voltage being greater than the average positive voltage. The coloring results are compared below in Table 5, with Example 5 shown first and followed by Example 6.

TABLE 5

| Waveform | Color Program | Throwing Power (Loss of Color in Area) | Overall Color |
|---|---|---|---|
| Modified sine waveform FIG. 2(b) (Prior art) | +3 V, −3 V 2.0 min. | A severe/ champagne B slight/ medium bronze | Medium Bronze - Not Uniform |
| Modified AC Sine waveform 10 FIG. 3 | +2 V, −8 V 2.0 min. | A none/dark bronze B none/dark bronze | Dark Bronze - All Uniform |

Results

Using waveform 10, the best color uniformity, throwing power, coloring speed and anode dissolution over the other waveforms was obtained, while maintaining the capability to subtract color.

Figure 7:
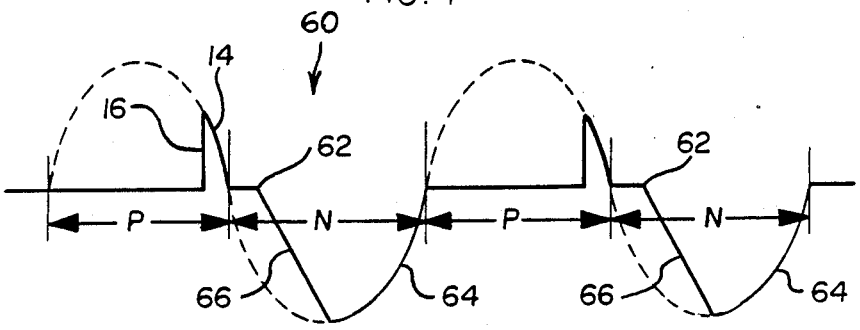
FIG. 7 illustrates an alternative modified sinusoidal waveform in accordance with the principles of this invention.

As an alternative to the full-half cycle negative portion 12 of FIG. 3, less than half cycle can be utilized using suitable timing of thyristor 40 of FIG. 5. Reference may be made to FIG. 7 wherein waveform 60 is illustrated with positive half section P and negative half wave section N. Notice that the same leading edge 16 and positive portion 14 can be provided as in waveform 10 of FIG. 3. However, now thyristor 40 of FIG. 5 may be gated at time 62 so that with resistor 42 and the normally capacitive load, the negative half cycle portion 64 includes a controlled, relatively long rise time of leading edge 66. Similarly, the average voltage of negative portion 64 is equal to or greater than the average voltage of positive 14. The rise time tp of leading edge 16 is still much faster than the rise time tn of leading edge 66. The improved throwing power of waveform 60 along with improved all around coloring performance was obtained in comparison to prior art waveforms.

Figure 8:
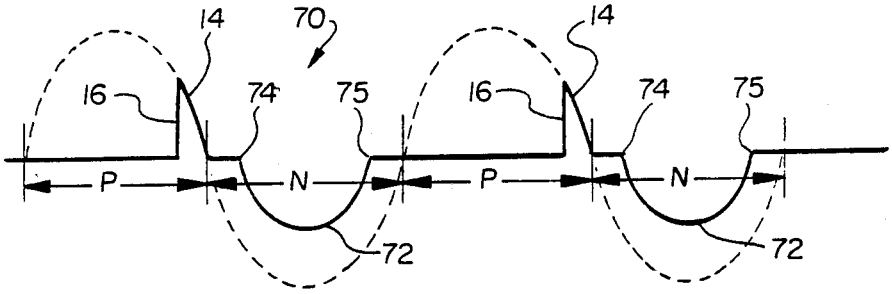
FIG. 8 illustrates another alternative modified sinusoidal waveform in accordance with the principles of this invention.

FIG. 8 illustrates another alternative sinusoidal voltage waveform 70 wherein the positive half cycle portion 14 has leading edge 16 as illustrated previously in connection with FIGS. 3 and 7. Negative half cycle portion 72 is formed of a sinusoidal waveform starting at reference point 74 in the negative half cycle of waveform 70 and ending at reference point 75.

Figure 9A:
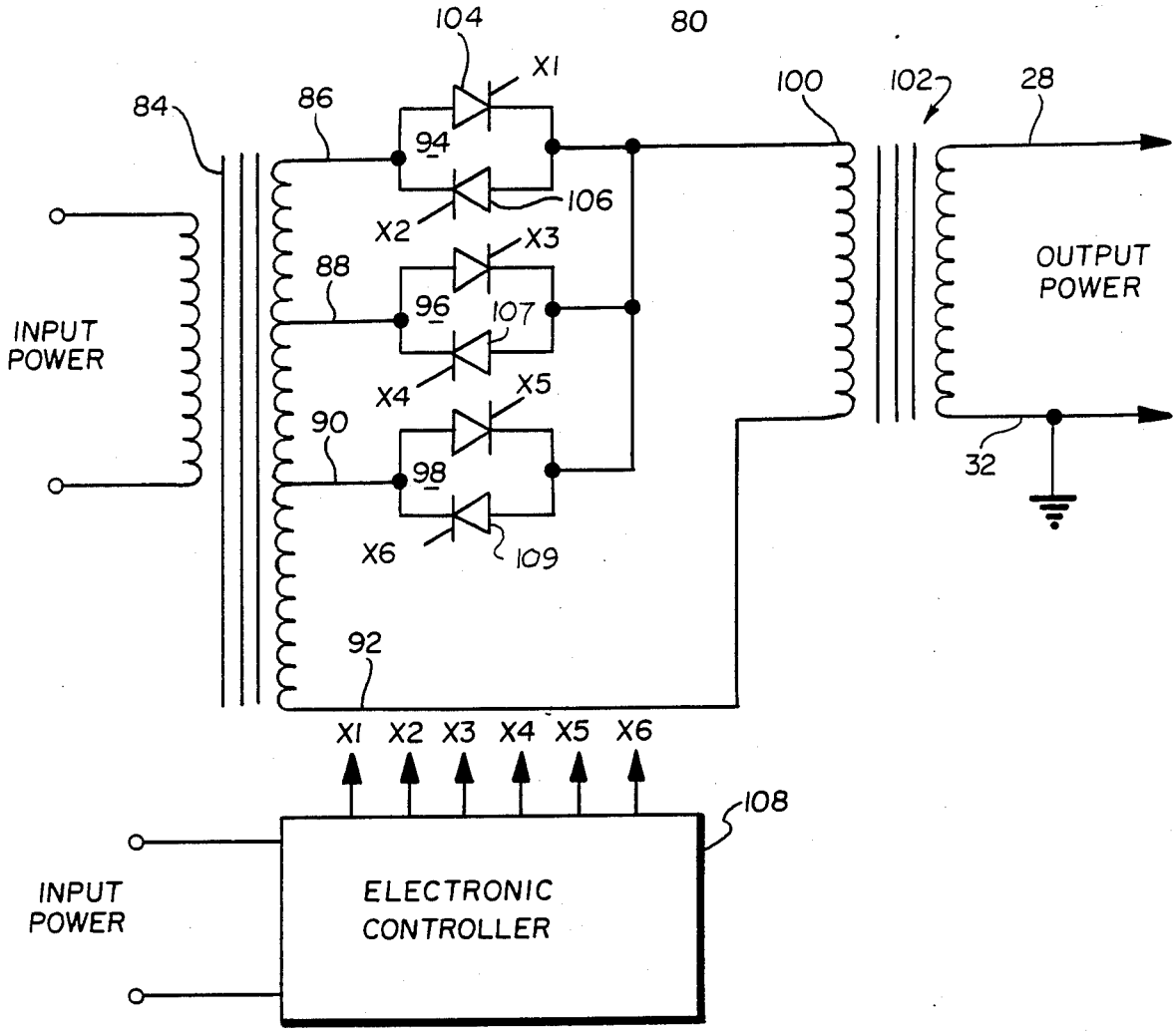
FIG. 9(*a*) is a schematic diagram of another alternative power supply apparatus and FIG. 9(*b*) illustrates a modified sinusoidal voltage waveform produced by the apparatus of FIG. 9(*a*).
Figure 9B:
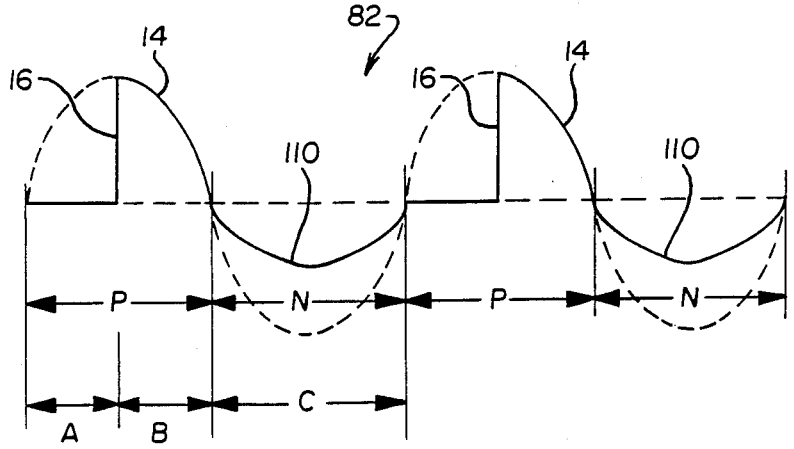

Referring now to FIGS. 9(*a*) and 9(*b*), there is illustrated apparatus 80 which provides waveform 82. Apparatus 80 is a thyristor switched multitap transformer power supply with outputs 28, 32 for connection respectively to anodized aluminum workpiece 30 and counter electrode 34. Transformer 84 has secondary terminal tap points 86, 88, 90, 92. Taps 86, 88, 90, are connected to respective reverse connected thyristor pairs 94, 96, 98 with the output ends thereof tied together and connected to one end of the primary 100 of output transformer 102. Tap 92 is connected to the other end of primary 100.

Each of the paired thyristors 94 has respective gate controlled signals for controlling the firing of the thyristor during the positive and negative half cycle portions of the sinusoidal voltage waveform input to the primary of transformer 84. As an example, thyristor gate control signal X1 controls thyristor 104 and gate control signal X2 controls thyristor 106. Thyristor pair 96 includes similar gate control signals X3, X4; and thyristor pair 98 is gated by gate control signals X5, X6.

The thyristor gate control signals X1–X6 are supplied by an electronic controller 108 having analog timing and logic circuits for timing the application of the control signals X1–X6 to the thyristor pairs 94, 96, 98 for providing the desired modified sinusoidal voltage waveform in accordance with the principles of the present invention. Alternatively, electronic controller 108 may be supplied by a programmable controller device to provide the desired timing of gate control signals X1–X6.

FIG. 9(*b*) illustrates a modified sinusoidal voltage waveform 82 as an example of a waveform in accordance with the present invention. In waveform 82, the positive average voltage substantially equals the negative average voltage so that as illustrated for instance in the above Example 4, the best throwing power is attained but with reduced coloring speed. In FIG. 9(*b*), negative half cycle portion 110 is a sinusoidal waveform provided during the entire half cycle portion N of waveform 82 but reduced in peak amplitude compared to the positive half cycle portion 14. In the illustration of FIG. 9(*b*), negative half cycle portion 110 has an average voltage value which equals the average voltage value of the positive half cycle portion.

In connection with the development of waveform 82, the waveform, for convenience in illustration of the timing control technique, may be divided into timing portions A, B and C for the full cycle of waveform 82 as illustrated in FIG. 9(*b*). In timing portion A, none of the timing control signals X1–X6 are present so that none of the thyristors are fired. In timing portion B, only control signal X1 is present so that thyristor 104 is fired to provide leading edge 16 and the positive half cycle 14 of waveform 82. During timing control portion C, control signal X4 or timing control signal X6 is present to fire either thyristor 107, or thyristor 109 to provide the reduced average voltage of negative half cycle waveform portion 110.

It is understood, of course, that rather than the waveform 82 having a positive average voltage substantially equal to the negative average voltage, other waveforms, such as illustrated in FIGS. 3, 7, 8 may be provided wherein the average of the negative half cycle portion is greater than the average of the positive half cycle portion. As indicated previously, in accordance with one aspect of the present invention, good throwing power may be obtained with good coloring speed in this latter instance.

The foregoing detailed description has been given for clearness of understanding only, and no unnecessary limitations should be understood therefrom, as modifications will be obvious to those skilled in the art.

We claim:

1. In a two-step process for the electrolytic coloring of anodized aluminum, using an electrode and the anodized aluminum immersed in an electrolyte, including first anodizing the aluminum to provide an oxidized film on its surface, an improved second coloring step comprising:

providing a modified sinusoidal voltage waveform, including providing a sinusoidal waveform having a respective positive and negative one-half cycle sinusoidal portion, and modifying the sinusoidal waveform to provide the negative one-half cycle portion having, (1) a leading edge rise time which is substantially longer than the leading edge rise time of the positive one-half cycle portion, and (2) an average voltage which is greater than the average voltage of the positive one-half cycle portion; and applying said modified sinusoidal voltage waveform to said anodized aluminum and the electrode to color the oxidized film while providing good throwing power, good coloring speed, good color uniformity, good electrode dissolution and with the capability to subtract color.

2. The process of claim 1, wherein a full half cycle waveform is provided in the negative one-half cycle portion.

3. The process of claim 1, wherein less than a full half cycle waveform is provided in the negative one-half cycle portion.

4. In a two-step process for the electrolytic coloring of anodized aluminum, using an electrode and the anodized aluminum immersed in an electrolyte, including first anodizing the aluminum to provide an oxidized film on its surface, an improved second coloring step comprising:

providing a modified sinusoidal voltage waveform, including providing a sinusoidal waveform having a respective positive and negative one-half cycle sinusoidal portion, and modifying the sinusoidal waveform to provide the negative one-half cycle portion having, (1) a leading edge rise time which is substantially longer than the leading edge rise time of the positive one-half cycle portion, and (2) an average voltage which is equal to the average voltage of the positive one-half cycle portion; and applying said modified sinusoidal voltage waveform to said anodized aluminum and the electrode to color the oxidized film while providing excellent throwing paper, fair coloring speed, good color uniformity, and good electrode dissolution.

5. The process of claim 4, wherein a full half cycle waveform is provided in the negative one-half cycle portion.

6. The process of claim 4, wherein less than a full half cycle waveform is provided in the negative one-half cycle portion.

7. In a two-step process for the electrolytic coloring of anodized aluminum, using an electrode and the anodized aluminum immersed in an electrolyte, including first anodizing the aluminum to provide an oxidized film on its surface, an improved second coloring step comprising:

providing a modified sinusoidal voltage waveform, including providing a sinusoidal waveform having a respective positive and negative one-half cycle sinusoidal portion, and modifying the sinusoidal waveform to provide the negative one-half cycle portion having, (1) a leading edge rise time which is substantially longer than the leading edge rise time of the positive one-half cycle portion, such that the slope of the negative leading edge is less than about 15–70 or more kilovolts/second and the slope of the positive leading edge is greater than about 15–70 kilovolts/second, and (2) an average voltage which is greater than about the average voltage of the positive one-half cycle portion; and applying said modified sinusoidal voltage waveform to said anodized aluminum and the electrode to color the oxidized film while providing good throwing paper, good coloring speed, good color uniformity, good electrode dissolution and with the capability to subtract color.

8. In a two-step process for the electrolytic coloring of anodized aluminum, using an electrode and the anodized aluminum immersed in an electrolyte, including first anodizing the aluminum to provide an oxidized film on its surface, an improved second coloring step comprising:

providing a modified sinusoidal voltage waveform, including providing a sinusoidal waveform having a respective positive and negative one-half cycle sinusoidal portion, and modifying the sinusoidal waveform to provide the negative one-half cycle portion having, (1) a leading edge rise time which is substantially longer than the leading edge rise time of the positive one-half cycle portion, such that the slope of the negative leading edge is less than about 15–70 or more kilovolts/second and the slope of the positive leading edge is greater than about 15–70 kilovolts/second, and (2) an average voltage which is equal to the average voltage of the positive one-half cycle portion; and applying said modified sinusoidal voltage waveform to said anodizing aluminum and the electrode to color the oxidized film while providing excellent throwing paper, fair coloring speed, good color uniformity, and good electrode dissolution.

* * * * *

UNITED STATES PATENT AND TRADEMARK OFFICE

CERTIFICATE OF CORRECTION

PATENT NO. : 4,931,151

DATED : June 5, 1990

INVENTOR(S) : KOLLENGODE V. SRINIVASAN, ET AL.

It is certified that error appears in the above-identified patent and that said Letters Patent is hereby corrected as shown below:

On the title page, in the abstract, line 16, change "tha capability" to --the capability--.

Col. 10, line 17, delete the word "about".

Col. 10, line 46, change "anodizing aluminum" to --anodized aluminum--.

Signed and Sealed this

Eleventh Day of February, 1992

*Attest:*

*Attesting Officer*

HARRY F. MANBECK, JR.

*Commissioner of Patents and Trademarks*